US009493335B2

(12) United States Patent
Calza'

(10) Patent No.: US 9,493,335 B2
(45) Date of Patent: Nov. 15, 2016

(54) PROCESS FOR MANUFACTURING MOUTHPIECES OF HORSE BITS AND PRODUCT OBTAINED WITH SAID PROCESS

(75) Inventor: Flavio Calza', Villafranca Padovana (IT)

(73) Assignee: EQUILINE S.R.L., Trebaseleghe (PD) (IT)

( * ) Notice: Subject to any disclaimer, the term of this patent is extended or adjusted under 35 U.S.C. 154(b) by 49 days.

(21) Appl. No.: 14/241,350

(22) PCT Filed: Sep. 9, 2011

(86) PCT No.: PCT/IB2011/053941
§ 371 (c)(1),
(2), (4) Date: Feb. 26, 2014

(87) PCT Pub. No.: WO2013/034955
PCT Pub. Date: Mar. 14, 2013

(65) Prior Publication Data

US 2014/0223867 A1 Aug. 14, 2014

(30) Foreign Application Priority Data

Sep. 5, 2011 (IT) ..... PD2011A0282

(51) Int. Cl.
*B68B 1/06* (2006.01)
*C25D 5/34* (2006.01)

(52) U.S. Cl.
CPC .. *B68B 1/06* (2013.01); *C25D 5/34* (2013.01)

(58) Field of Classification Search
CPC ..... B68B 1/06; C25D 5/34; C25D 5/42
See application file for complete search history.

(56) References Cited

U.S. PATENT DOCUMENTS 3,205,636 A * 9/1965 Laningham ..... B68B 1/06 54/8
3,345,278 A * 10/1967 Mekjean ..... C23F 13/005 204/274
3,478,493 A * 11/1969 Welton ..... B68B 1/06 54/15
3,756,937 A * 9/1973 Lucas et al. ..... B23H 9/06 204/224 M
5,232,361 A * 8/1993 Sachdeva ..... A61C 7/12 433/8
6,324,821 B1 12/2001 Bauer
6,605,365 B1 * 8/2003 Krienke ..... B05D 3/102 428/328
6,607,386 B1 * 8/2003 Andersson ..... A61C 5/10 433/201.1
6,848,242 B2 * 2/2005 Chang ..... B68B 1/06 54/9
7,775,023 B2 * 8/2010 Vollmecke ..... B68B 1/06 54/8
2004/0258726 A1 * 12/2004 Stupp ..... A61L 27/32 424/423
2005/0183952 A1 * 8/2005 Shimamune ..... C23C 18/1216 204/290.01
2005/0216093 A1 * 9/2005 Kuboki ..... A61L 27/06 623/23.53
2006/0285991 A1 * 12/2006 McKinley ..... B22F 3/225 419/36
2008/0237033 A1 * 10/2008 Misiano ..... A61L 27/306 204/192.15
2009/0324810 A1 * 12/2009 Serikawa ..... C02F 1/46109 427/78
2010/0261034 A1 * 10/2010 Cardarelli ..... A61L 27/42 428/615

FOREIGN PATENT DOCUMENTS

JP 2006160596 A * 6/2006 ..... C01G 25/02
WO 2006012814 2/2006
WO 2007144916 12/2007

* cited by examiner

*Primary Examiner* — Kathleen Alker
(74) *Attorney, Agent, or Firm* — Themis Law

(57) ABSTRACT

A process for making mouthpieces for the bits of horses and draught animals includes the following steps: making the mouthpiece with titanium or titanium alloys through a turning and removal operation, sandblasting with zirconium microspheres, and passivation through oxidation of the surface titanium by means of acid solutions. The mouthpiece obtained with such a process is completely made of titanium or titanium alloys and has a passivated surface, that is, a surface that is better resistant to corrosion.

3 Claims, No Drawings

PROCESS FOR MANUFACTURING MOUTHPIECES OF HORSE BITS AND PRODUCT OBTAINED WITH SAID PROCESS

FIELD OF THE INVENTION

The present patent concerns horse bits and the processes used to make them, and in particular it concerns a new process for making horse bit mouthpieces in titanium or titanium alloys and the product obtained therewith.

BACKGROUND OF THE INVENTION

There are known types of harness for riding and/or handling horses, which include saddles, stirrups, reins, bits, and so on.

There are known headpieces and nose bands, i.e. belts that embrace the horse's head and that are used to control the animal by the rider or the person leading a horse or driving a horse-drawn vehicle.

In particular, the known headpieces comprise reins, which are strips of leather or lengths of cord attached to the ends of a metal element inserted in the horse's mouth, known as bit.

Said reins are held by the horse rider or the person leading the horse or driving a horse-drawn vehicle, who takes action thereon to change the direction in which the horse moves. In fact, said reins pull on said bit, which in turn comes to bear on the sides of the horse's mouth, and particularly in line with the corners of its mouth, which are extremely sensitive.

There are various known types of horse bits. Generally speaking, a bit is a metal element that is partially positioned inside the horse's mouth, at the level of a space in the jaw, known by the name of bar, with no teeth.

The bits of the known state of the art comprise at least one central element, or mouthpiece, usually with rings on either side for attaching the reins.

Said mouthpiece may be a single element or may be jointed at one or more points, while various types of rein ring are known, such as the D-shaped rings, for instance.

The mouthpiece is inserted over the tongue and presses on the bars, where the jawbone is covered only by a thin layer of gum and is consequently extremely sensitive.

It is important for the type of bit to be suited to the horse, i.e. it must be of suitable size in order to function effectively and cause the horse the least possible discomfort.

In the known types of bit, the mouthpiece, i.e. the part inserted inside the horse's mouth, may be completely or partly made of steel, iron, copper, aluminum, or various types of alloys and combinations of the same.

Some of these metals, including iron and copper, deteriorate with time, especially due to the oxidizing effect of the horse's saliva and water.

It is also common knowledge that not all metal materials are biocompatible, i.e. they are not all suitable for coming into contact with an animal's teeth, gums and oral cavity in general.

Furthermore, traditional horse bits are made with some types of metal that generate an exchange of galvanic currents on the piece surface and that with these currents stimulate the horse's salivation.

Mouthpieces are known that are made using parts in titanium, a metal characterized by exceptionally light weight and high resistance.

Titanium is also very corrosion-resistant and is biocompatible because it has a surface porosity similar to that of animal tissues, so it is physiologically inert.

At present the pieces are worked with traditional mechanical tools such as lathes and cutters. These types of processing often cause the formation of microcracks that lead to the generation of flaws in the material, with the risk that the piece, if subjected to mechanical stress, may even break.

SUMMARY OF THE INVENTION

The objects of the present invention are a new process for making the mouthpieces of horse bits and the product obtained therewith.

The main object of the present invention is to provide mouthpieces that are resistant to corrosion, light and sturdy.

Another object of the present invention is to provide mouthpieces made of a non-toxic and biocompatible material, suitable for being inserted in the oral cavity and for coming into contact with the animal's teeth, mandibular arches, palate and tongue.

These and other direct and complementary objects are achieved by the new process for making horse bit mouthpieces in titanium or titanium alloys and by the product obtained therewith.

DETAILED DESCRIPTION OF EMBODIMENTS OF THE INVENTION

A process according to the invention comprises the following steps:

making the body of the mouthpiece in titanium or titanium alloys through a turning or removal operation;

carrying out a sandblasting treatment with zirconium microspheres;

subjecting the titanium surface to passivation through anodic oxidation, for example by using acid solutions.

The mouthpiece obtained in this way comprises a body completely made of titanium or titanium alloys.

The mouthpiece in titanium or titanium alloys obtained in this way is much lighter than the mouthpieces made of other known materials and is consequently better tolerated by horses.

Said surface sandblasting treatment with zirconium microspheres makes the body of the mouthpiece more resistant to fatigue compared to the usual surface finish obtained by machining, i.e. through milling and cutting only.

In fact, the rounding of the sharp parts and the hammering effect due to the impact of the zirconium microspheres against the surface of the piece make the material of the finished piece more compact and reduces to the minimum the breakage factor usually due to the microcracks that instead would be generated through the use of traditional mechanical tools, especially if they are worn out.

Therefore, the surface sandblasting treatment with zirconium microspheres makes the piece more resistant to fatigue.

The further passivation treatment contributes to raising the oxide layer, in order to make the bit completely inert inside the horse's mouth.

Said passivation treatment through anodic oxidation preferably takes place in an electrolytic bath and the thickness of the natural layer of titanium oxide that is formed ranges from just a few Amstrong to ⅔ micron. This oxide layer is integral with the underlying titanium and ensures higher protection from galvanic currents to the entire unit.

Thus, said surface passivation treatment of the titanium piece completely inhibits the exchange of galvanic currents on the same piece and consequently also inside the horse's mouth.

The new titanium mouthpiece naturally stimulates salivation inside the horse's mouth and therefore contributes to his wellbeing.

The new piece obtained with a process according to the invention is extremely comfortable for the animal, mainly thanks to the extreme biocompatibility of titanium.

Furthermore, titanium always maintains a temperature equal to room temperature, and thus does not generate thermal shocks inside the mouth.

Titanium is an a magnetic metal, and as such is inert to the magnetic fields created by the earth without any electric stimulation.

The new mouthpiece obtained with a process according to the invention is thus very strong also from the mechanical point of view and does not suffer from corrosion or oxidation as a result of contact with the animal's saliva.

The new mouthpiece is highly tolerated by the animal's body and can consequently be inserted in the horse's oral cavity with a minimal risk of inflammation or problems to the animal's teeth and bone.

The mouthpiece obtained with the above described process can be shaped like known mouthpieces, can be jointed at one or more points, and its shape and size are designed in such a way as to make it suited to be inserted in the horse's mouth in line with the bars.

Preferably, the new mouthpiece also comprises a ring at each outer end, so that said rings are situated on the outside of the animal's mouth and are suitable for attaching the ends of the reins with which the horse rider or the person leading a horse or driving a horse-drawn vehicle can take action on the bit.

Therefore, with reference to the above description, the following claims are expressed.

The invention claimed is:

1. A process of making mouthpieces for bits of horses or draft animals, comprising the following steps:

(a) making all or part of a body of a mouthpiece for a bit of a horse or draft animal in titanium or a titanium alloy through a turning or milling operation;

(b) carrying out a sandblasting treatment on said body of the mouthpiece; and (c) subjecting the titanium on a surface of the mouthpiece to a passivation treatment through oxidation.

2. The process according to claim 1, wherein said sandblasting treatment is carried out using zirconium microspheres.

3. The process according to claim 1, wherein said passivation treatment takes place through anodic oxidation in an electrolytic bath.

* * * * *